US007256664B1

(12) United States Patent
Blacka et al.

(10) Patent No.: US 7,256,664 B1
(45) Date of Patent: Aug. 14, 2007

(54) VOLTAGE CONTROLLED ATTENUATOR WITH NO INTERMODULATION DISTORTION

(75) Inventors: Robert J. Blacka, Pennsauken, NJ (US); Nelson Roldan, Boca Raton, FL (US)

(73) Assignee: Smiths Interconnect Microwave Components, Inc., Stuart, FL (US)

( * ) Notice: Subject to any disclaimer, the term of this patent is extended or adjusted under 35 U.S.C. 154(b) by 176 days.

(21) Appl. No.: 11/107,586

(22) Filed: Apr. 15, 2005

(51) Int. Cl.
*H01P 1/22* (2006.01)

(52) U.S. Cl. ..... 333/81 R

(58) Field of Classification Search ..... 333/81 A, 333/81 R, 17.2; 327/308, 309
See application file for complete search history.

(56) References Cited

U.S. PATENT DOCUMENTS 4,340,780 A * 7/1982 Odlen ..... 381/103

5,999,064 A * 12/1999 Blacka et al. ..... 333/81 R

* cited by examiner

*Primary Examiner*—Stephen E. Jones
(74) *Attorney, Agent, or Firm*—Morgan, Lewis & Bockius LLP

(57) ABSTRACT

A preferred embodiment of the present invention comprises at least first and second thermistors, arranged into a classical Tee, Pi, or Bridged Tee attenuator design, a heating element, a temperature sensor, and a control circuit. The thermistors have different temperature coefficients of resistance and are in close proximity to the heating element and the temperature sensor. The control circuit receives a voltage signal from the temperature sensor, compares that signal with a voltage signal specifying a desired temperature, and applies electrical energy to the heating element until receiving a signal from the temperature sensor that the temperature of the thermistors matches the desired temperature. As a result, the attenuation of the attenuator can be changed at a controlled rate by varying the temperature of the thermistors, while the impedance of the attenuator remains within acceptable levels.

18 Claims, 6 Drawing Sheets

Fig. 1A (Prior Art)
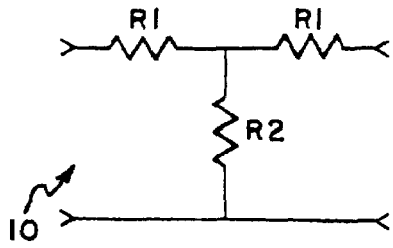
Fig. 1B (Prior Art)
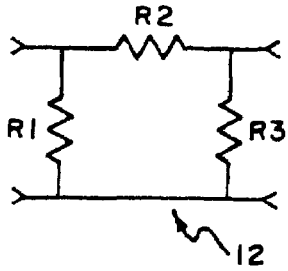
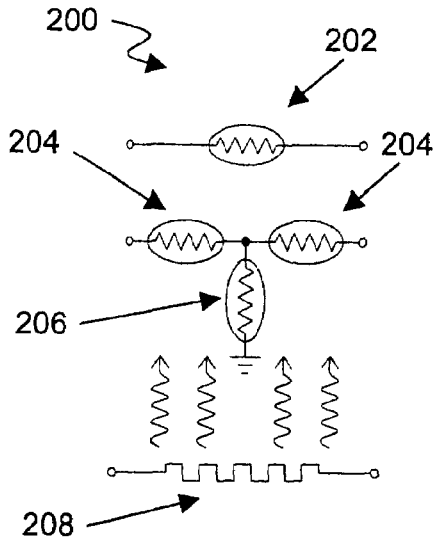
Fig. 2
Fig. 1C (Prior Art)
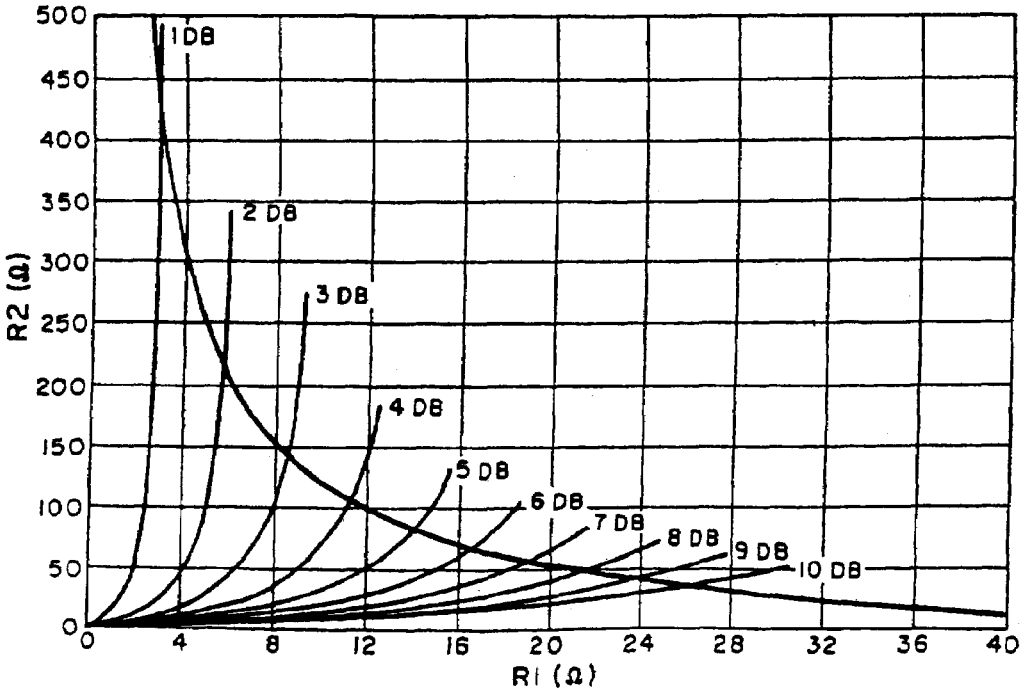

VOLTAGE CONTROLLED ATTENUATOR WITH NO INTERMODULATION DISTORTION

CROSS-REFERENCE TO RELATED APPLICATION

A related application is application Ser. No. 11/107,556, filed concurrently herewith for "Wideband Temperature Variable Attenuator," the disclosure of which are incorporated herein by reference.

FIELD OF INVENTION

The present invention relates to a voltage controlled attenuator (VCA) for RF (radio frequency) and microwave applications that is free of intermodulation distortion. More particularly, the present invention relates to an attenuator that is controlled based upon temperature and does not include active devices.

BACKGROUND OF THE INVENTION

VCAs are a fairly common element of almost any RF or microwave circuit. Their function is to change the amplitude of a signal based on some external signal, usually a voltage or current. A common use is the leveling of a signal so that both strong and weak signals can be adjusted in amplitude to provide a constant level signal to the next stage of the circuit. Another use is the balancing of multiple signal paths so they all have the same gain. A third use would be to use a VCA to control the gain of an amplifier over temperature by varying the control voltage based on a measurement of the ambient temperature. This last use is to counter undesired changes to the gain of the amplifier when the ambient temperature changes.

The vast majority of presently available VCAs include either diodes, transistors, or FETs (field effect transistors). These active devices have non-linear transfer characteristics which result in distortion to RF and microwave input signals. This causes additional and unwanted signals to be generated which are not present in the original signal. For example, suppose two people are transmitting a signal (from a cell phone, for instance) on two different frequencies at the same time. If the two signals were applied to a non-linear device, several additional signals would be generated that would be on frequencies that are different from the original two frequencies. This is known as intermodulation distortion. These additional signals have the potential of causing interference to other services, like police or fire departments that use the same frequencies as the additional signals.

VCAs are designed to reduce intermodulation distortion to the smallest possible value, but due to the non-linear characteristics of the control devices used, there is no way to eliminate intermodulation distortion entirely. Therefore, there exists a real and present need for a VCA that can control the amplitude of an RF or microwave signal without generating any distortion products which result in intermodulation distortion.

U.S. Pat. No. 5,332,981, issued to Joseph B. Mazzochette, et al., issued Jul. 26, 1994, entitled "Temperature Variable Attenuator," which is incorporated herein by reference, describes an attenuator that includes temperature variable resistors (thermistors) in the attenuating path. As shown in FIGS. 1A and 1B which are reproduced from FIGS. 1 and 3 of the '981 patent. conventional attenuators include a Tee attenuator 10 comprising a pair of identical series resistors R1 and a shunt resistor R2 and a Pi attenuator 12 comprising a series resistor R2 and two shunt resistors R1 and R3. FIG. 1 C is a plot reproduced from FIG. 2 of the '981 patent, showing a family of constant attenuation curves from 1 to 10 dB and a constant 50 ohm impedance curve descending from the upper left of the plot to the lower right. The vertical axis on this plot represents the value of shunt resistor R2 in the T attenuator 10 and the horizontal axis represents the values of series resistors R1. The point of intersection between the 50 ohm impedance curve and an attenuation curve gives the value of R1 and R2 that produce the attenuation represented by the attenuation curve and a 50 ohm impedance match.

In the temperature variable attenuator of the '981 patent, the temperature coefficient of resistance (TCR) of at least one resistor is different such that the attenuation of the attenuator changes at a controlled rate with changes in temperature while the impedance of the attenuator remains substantially constant. Thus, this device changes its attenuation based on the ambient temperature, but because it is constructed entirely of passive components it does not generate any intermodulation distortion. However, the attenuation of this device cannot be set to a predetermined value based upon a constant external voltage or current.

U.S. Pat. No. 5,999,064, issued to Robert Blacka, et al., issued Dec. 7, 1999, entitled "Heated Temperature Variable Attenuator," which is also incorporated by reference, provides a heater in a temperature variable attenuator. The heater allows an external voltage or current to heat the thermistors that are part of the attenuating circuit to affect their resistance, and thus, the attenuation of the device. However, there are a number of limitations with this device which reduces its usefulness as a VCA.

SUMMARY OF THE INVENTION

The present invention is a VCA for RF and microwave applications that is free of intermodulation distortion. In a preferred embodiment, the present invention has at least first and second thermistors, arranged into a classical Tee, Pi, or Bridged Tee attenuator design, a heating element, a temperature sensor, and a control circuit. The thermistors have different temperature coefficients of resistance and are in close proximity to the heating element and the temperature sensor. The control circuit receives a voltage signal from the temperature sensor, compares that signal with a voltage signal specifying a desired temperature, and applies electrical energy to the heating element until receiving a signal from the temperature sensor that the temperature of the thermistors matches the desired temperature. As a result, the attenuation of the attenuator can be changed at a controlled rate by varying the temperature of the thermistors, while the impedance of the attenuator remains within acceptable levels.

In one embodiment, the temperature coefficient of resistance of one thermistor is zero. In another embodiment, the temperature sensor is also a thermistor. In yet another embodiment, the temperature sensor is a resistance temperature detector.

In a particular embodiment, the attenuator is constructed using thick-film or thin-film resistors that vary their resistance over temperature. In yet another embodiment, the thick-film or thin-film resistors are deposited onto a substrate of aluminum oxide, aluminum nitride, beryllium oxide, CVD diamond, or epoxy-glass laminate.

BRIEF DESCRIPTION OF THE DRAWINGS

These and other objects, features, and advantages of the invention will be more readily apparent from the following detailed description in which:

FIGS. 1A–1C depict aspects of prior art temperature variable attenuators;

FIG. 2 is a schematic diagram showing the basic structure of an attenuator in accordance with the present invention

DETAILED DESCRIPTION OF THE INVENTION

Figure 4:
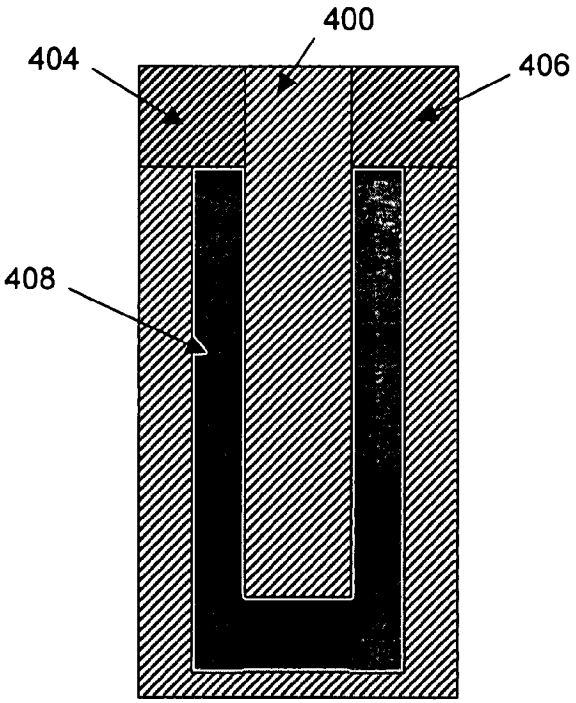
FIG. 4 is the top view of a heating structure in the embodiment of the present invention shown in FIG. 3.

FIG. 2 is a schematic diagram of an illustrative attenuator 200 of the present invention. Attenuator 200 includes a pair of identical series thermistors 204 and shunt thermistor 206. These thermistors are arranged in a classical Tee attenuator design. The attenuator also includes temperature sensor 202 and heating element 208. Thermistors 204 and 206 are arranged relative to heating element 208 and temperature sensor 202 such that they are simultaneously heated by heating element 208, and their temperature is detected by temperature sensor 202.

Figure 3:
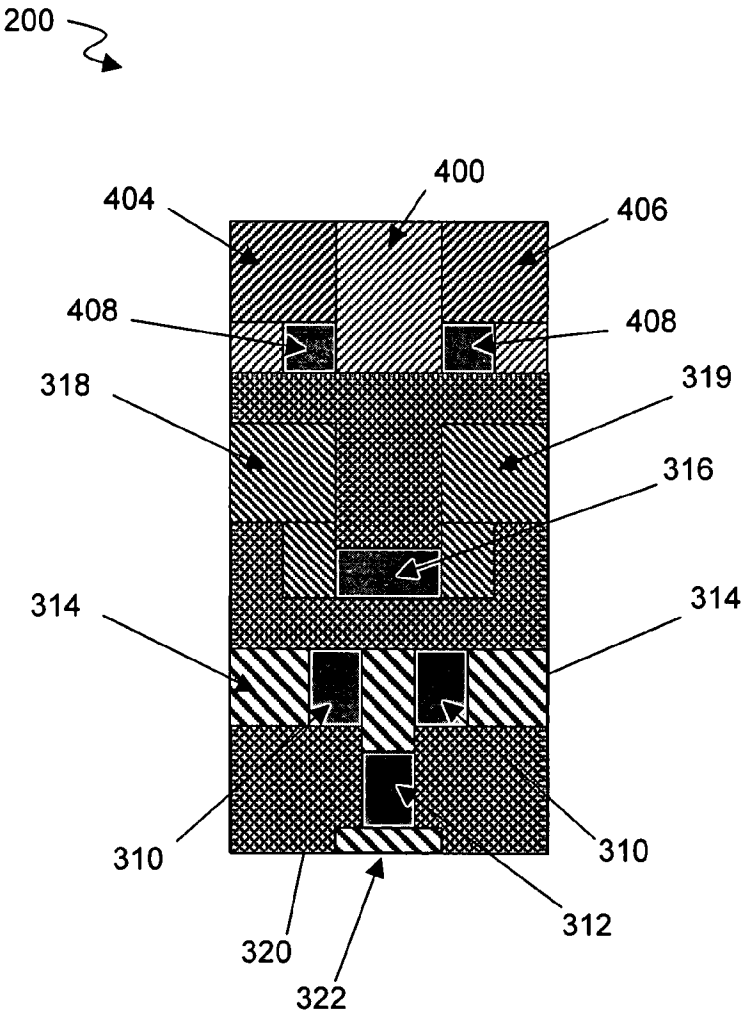
FIG. 3 is the top view of an embodiment of the present invention.
Figure 5:
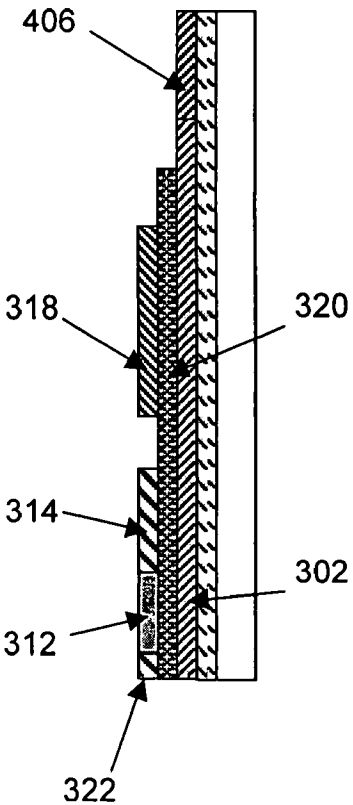
FIG. 5 is the side view of the embodiment of the present invention shown in FIG. 3.

A physical embodiment of the attenuator of FIG. 2 is shown in FIGS. 3–5. FIG. 3 is a top view of attenuator 300, FIG. 4 is a top view of a heating structure 400 of the attenuator and FIG. 5 is a side view. As shown in FIG. 5, attenuator 300 is formed on substrate 500. Substrate 500 is an insulating material such as aluminum oxide (alumina), aluminum nitride (ALN), beryllium oxide (BeO), CVD diamond, or epoxy-glass laminate. A ground plane 501 of platinum, silver or a platinum silver alloy is formed on one side of substrate 500. Optionally, a dielectric layer 502 is formed on the opposite side of substrate 500. Heating structure 400 is formed on dielectric layer 502, if present, or on substrate 500. As shown in the top view of FIG. 4, heating structure 400 comprises a dielectric layer 502 in which are formed heater contact areas 404, 406 and a U-shaped heating element 408. Heating element 408 is positioned such that it electrically extends between and contacts first and second heater contact areas 404 and 406. As best shown in the side view of FIG. 5, a layer of insulating material 320 covers most of heating element 408 but not contact areas 404, 406.

Temperature sensor 202 and thermistors 204 and 206 are realized in the implementation of FIGS. 3–5 as sensor 316 and thermistors 310 and 312 which are formed on insulating material 320. Thermistors 310 and 312 are each positioned to extend at least across a portion of heating element 408. The thermistors are electrically connected to each other at node 311, thermistors 310 are electrically connected to contact areas 314 and thermistor 312 is electrically connected to contact area 322. Contact area 322 is connected to ground plane 501 on the underside of substrate 500 by a ground wrap connector on the outside of the substrate or by a via through the substrate. Temperature sensor 316 is positioned so that it is in close enough proximity to thermistors 310 and 312 to detect their temperature and is an electrical contact with first and second sensor contact areas 318 and 319.

Figure 6:
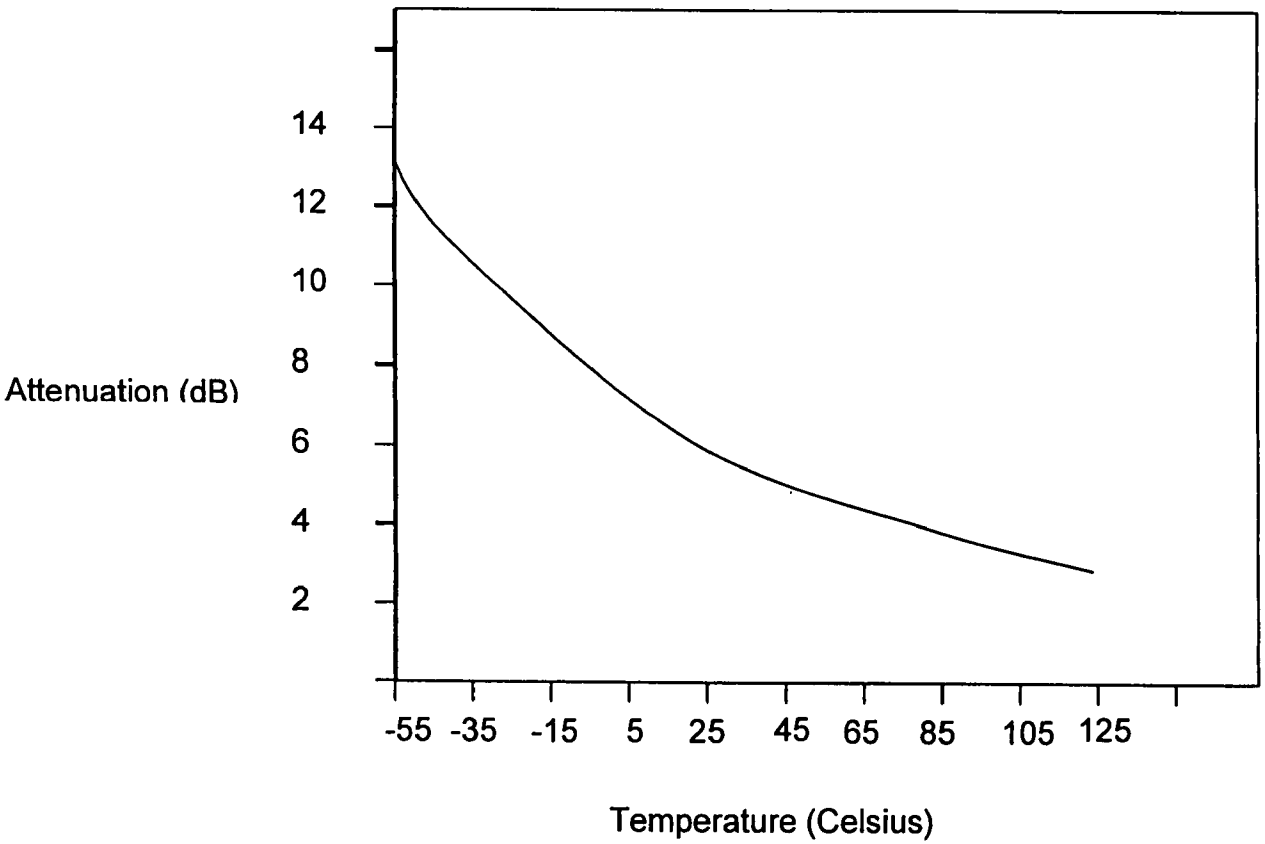
FIG. 6 is a graph depicting the attenuation produced at given temperature in an illustrative embodiment of the invention.

The attenuating characteristics of attenuator 300 as a function of temperature can be determined simply by measuring them over the operating range of the attenuator. For example, in an illustrative embodiment of the inventory, the variation of attenuation with temperature might be determined to be that shown in the graph of FIG. 6. Once this functional relationship is known, any attenuation over the operating range of attenuator 300 can be selected by accurately controlling the temperature of thermistors 310 and 312 so as to achieve the attenuation known to correspond to that temperature. This temperature control is accomplished with external circuit 700 of FIG. 7 which constantly monitors the device temperature with temperature sensor 202/316 and controls the heat output from heating element 208/408.

Circuit 700 comprises an operational amplifier 710 having an inverting input connected to the node between an input resister R1 and a feedback resistor R2 and a noninverting input connected to the node between resistors R3 and R4 in a voltage divider network 720. The resistances of R1 and R3 are equal and the resistances of R2 and R4 are equal. Input resistor R1 is connected to a node in a temperature sensing circuit 730 comprising temperature sensor 202/316 and resistor R5. The voltage at this node is V1. The voltage applied to voltage divider 720 is V2. As a result, operational amplifier 710 functions as a differential amplifier that receives at its inverting and non-inverting terminals, respectively, signals proportional to V1 and V2 and produces an output signal $$V\ \text{out} = \frac{R1}{R2}(V2 - V1).$$

The output of operational amplifier is applied to a transistor 740 in a heating circuit 750 comprising transistor 740 and heating element 208/408.

Figure 7:
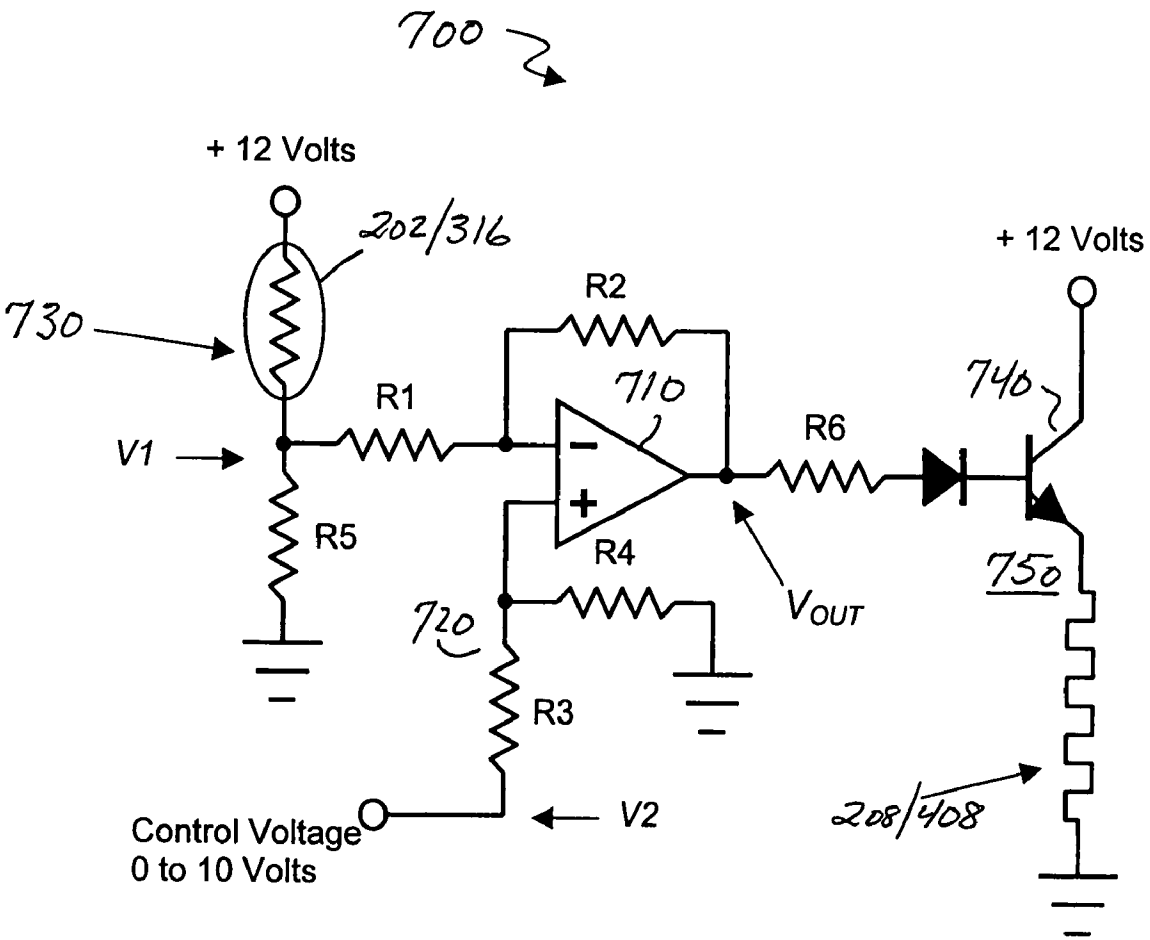
FIG. 7 is a circuit diagram showing the basic structure of a control circuit of an embodiment of the present invention.

For the circuit shown in FIG. 7, temperature sensor 202/316 has a negative temperature coefficient of resistance (TCR). As a result, as the temperature rises, voltage V1 increases monotonically. Voltage V2 specifies the desired operating temperature of the attenuator. Thus, the output of the operational amplifier is a signal proportional to the difference between the desired operating temperature and the actual operating temperature; and this signal is used to control the current flow in heating circuit 750 such that the amount of current flow is a function of the difference between the desired temperature and the actual temperature. Since the current flow through the heating circuit increases the temperature sensed by temperature sensing circuit 730, this increases V1 and thereby decreases the difference (V2–V1) until the temperature sensed by the temperature sensing circuit reaches the temperature specified by voltage V2.

Alternatively, circuit 700 would function in the same way if the positions of sensor 202/316 and resistor R5 in the temperature sensing circuit were interchanged and if sensor 202/316 had a positive TCR.

FIGS. 8A–8N are top views illustrating the sequence of steps in the formation of the attenuator of FIGS. 3–5. The starting material is a bare ceramic substrate typically measuring about 3 inches by 3 inches although other sizes of ceramic substrate may also be used in the practice of the invention. As mentioned above, suitable ceramic materials include aluminum oxide (Alumina), aluminum nitride (ALN), beryllium oxide (BeO), CVD diamond, or epoxy-glass laminates such as FR-4 or G-10. Low temperature co-fired ceramic may also be used as substrates in the practice of the invention. Individual devices that measure approximately 0.125 inches by 0.060 inches each are formed simultaneously on the ceramic substrate using screen printing technology in which layers of material are first printed on the substrate and then fired at an appropriate temperature in the range of 600 deg, C. to 900 deg. C. To maximize the number of devices formed on a substrate, the devices are aligned in a rectangular array. For convenience of illustration, FIGS. 8A–8N depict the steps performed in making one such device but it will be understood that the same steps are being performed simultaneously on all the devices being made on the ceramic substrate. At the end of the formation process, the ceramic substrate is scribed and the individual devices are separated using well-known techniques.

The underside of the ceramic substrate is first metallized as shown in FIG. 8B to provide ground plane 501 and first and second dielectric layers optionally are then deposited on the top-side of the substrate as shown in FIGS. 8C and 8D. Next, individual heater structures 400 are formed in FIGS. 8E and 8F by first printing gold contact layers 404, 406 and then printing heating elements 408. Illustratively, the resistance of each heating element 408 is 150 ohms. The heating structures 408 are then covered by one or more dielectric layers in FIGS. 8G and 8H.

Figure 8:
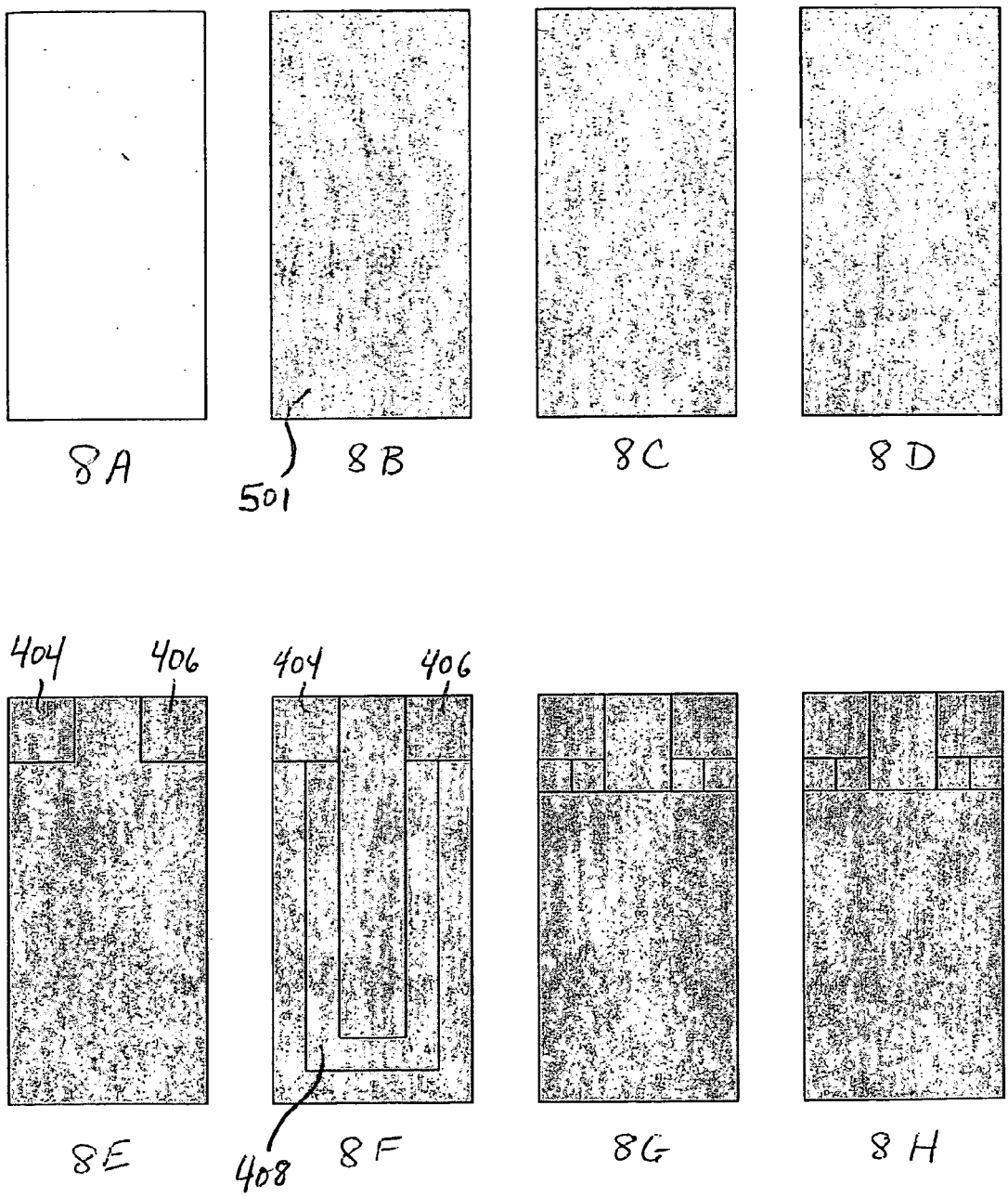
FIGS. 8A–8N are top views illustrating the sequence of steps in the formation of the attenuator of FIGS. 3–5.
Figure 8:
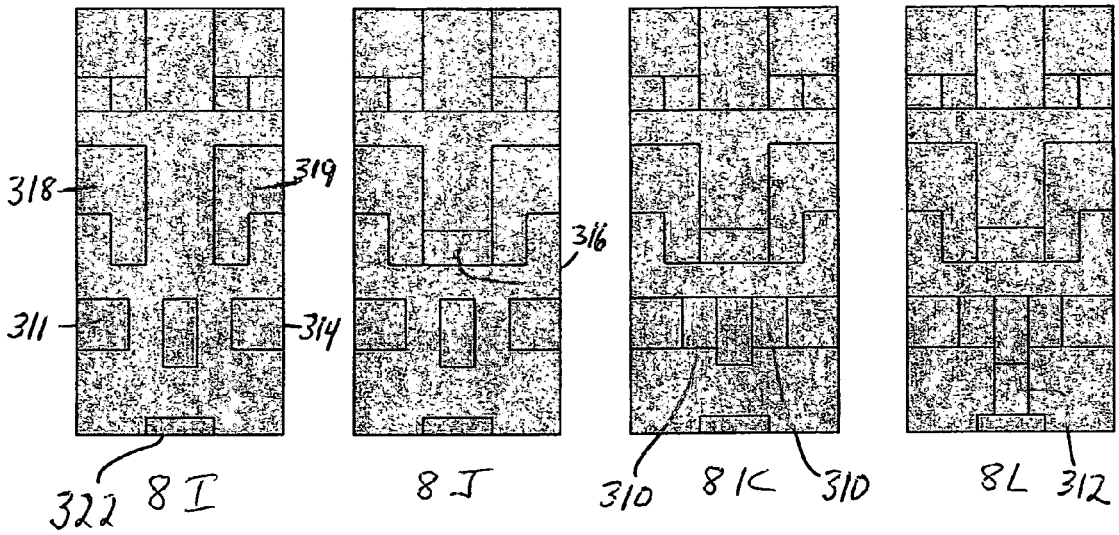
Figure 8:
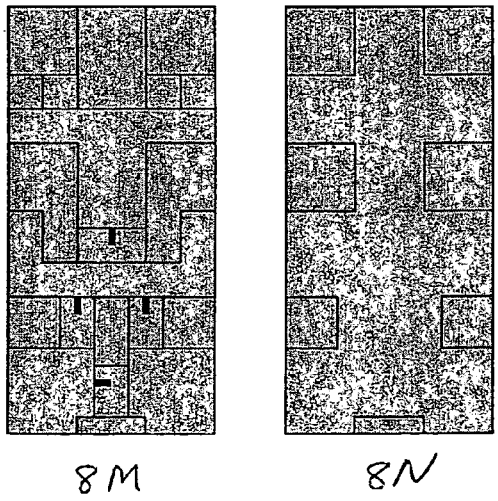

Gold contact areas 311, 314, 318, 319 and 322 are then printed in FIG. 81 and the temperature sensor 316 is printed in FIG. 8J. Illustratively, the temperature sensor is a thick-film 10K ohm thermistor with a negative temperature coefficient of resistance. Next, the attenuator is formed by screen printing the series thermistors 310 as shown in FIG. 8K and then the shunt thermistor 312 as shown in FIG. 8 L. Illustratively, the thermistors are thick-film thermistors and the series thermistors have a positive TCR and the shunt thermistor has a negative TCR. Alternatively, thin-film thermistors could be used for temperature sensor 316 and the series and shunt resistors.

As shown in FIG. 8M, the thermistors can then be laser-trimmed to adjust their resistance; and in FIG. 8N a protective layer is printed on the top surface. Product markings such as the manufacturer's name and part numbers can then printed on each device and the devices are then ready for testing. Following testing, the ceramic substrate is scribed and the individual devices are separated. Advantageously, the ground plane facilitates the soldering of the attenuator onto a larger substrate and electrical connections to the attenuator are made by wire bonding lead wires to the various contact areas. As will be apparent to those skilled in the art, the order of some of these steps can be varied. In addition, while firing would typically be carried out after each printing step, it may be advantageous to combine some of the firing steps.

The attenuators of the present invention are suitable for numerous applications including amplifier gain calibration, the balance of multiple channels and automatic gain control. They can be used to maintain oscillator output constant over frequency or reduce the output of a transmitter if the standing wave ratio is too high. They have an extremely wide frequency operating range being operable from DC to 20 GHz or higher. Since their components are completely passive, they are free of any distortion.

Typical specifications for the attenuators of the present invention are:

| | | |
|---|---|---|
| impedance | 50 | ohms nominal |
| frequency range | DC to 20 | GHz or higher |
| insertion loss | 1.5 | dB Max |
| attenuation range | 3 | dB above insertion loss |
| attenuation flatness | +/−0.25 | to dB to 10 GHz |
| VSWR | 1.3 | Max |
| response time | 100 | mS Max |
| RF power | 250 | mW Max |
| operating temperature | −55° C. to 125° C. | |

The foregoing description, for purposes of explanation, used specific examples to provide a thorough understanding of the invention. However, it will be apparent to one skilled in the art that the invention is not limited to these examples. The embodiments were chosen and described in order to best explain the principles of the invention and its practical applications, to thereby enable others skilled in the art to best utilize the invention and various embodiments with various modifications as are suited to the particular use contemplated. Thus, the foregoing disclosure is not intended to be exhaustive or to limit the invention to the precise forms disclosed. Many modifications and variations are possible in view of the above teachings.

While the invention was described for the example of a Tee attenuator, the invention may also be practiced using other attenuators such as a Pi attenuator or a bridged Tee attenuator in which a thermistor is connected in parallel to the pair of series resistors of the Tee attenuator. Of particular note, it should be observed that a wide range of attenuations can be achieved by appropriate selection of the TCRs of the various thermistors and whether the TCRs are positive or negative. In some cases, it is not necessary for every resistive element on the attenuator to have a resistance that varies with temperature and the invention may be practiced where one of the resistive elements has a zero TCR. As will be appreciated, the impedance that is observed over the operating frequency range and/or operating temperature range of the attenuator will not be precisely constant and the variation in impedance will depend on the amount of attenuation provided by the attenuator. At low attenuation, deviation from the desired impedance may be within +/− a few percent of the desired impedance over the operating range. At higher attenuations, deviation from the desired impedance can be expected to be higher, for example, +/−10%, +/−20%, and even +/−50% or more. In practice, considerable variation in impedance may be tolerated depending on the specific application in which the attenuator is used and the temperature and frequency range of use. As a rule of thumb, the variation in impedance of the attenuator should be such that the Voltage Standing Wave Ratio (VSWR) of the RF power is no more than 2.0:1 over the operating range of the attenuator.

It is intended that the scope of the invention be defined by the following claims and their equivalents.

What is claimed:

1. An attenuator comprising:

at least first and second thermistors with different temperature coefficients of resistance, said thermistors forming part of a circuit in which attenuation changes with changes in the temperature of the thermistors;

a heating element that heats the first and second thermistors;

a temperature sensor that monitors the temperature of the first and second thermistors;

wherein the attenuation of the attenuator can be controlled in response to a temperature sensed by the temperature sensor by applying electrical energy to the heating element.

2. The attenuator of claim 1 further comprising a control circuit that receives a signal from the temperature sensor, compares the signal from the temperature sensor to a signal representative of a desired temperature, and applies electrical energy to the heating element until receiving information from the temperature sensor that the temperature of the first and second thermistors matches the desired temperature.

3. The attenuator of claim 1 wherein the temperature coefficients of resistance are such that the attenuation of the attenuator changes with changes in the temperature of the thermistors while the impedance of the attenuator remains substantially constant as the attenuation changes.

4. The attenuator of claim 2, wherein the impedance of the attenuator is such that the Voltage Standing Wave Ratio (VSWR) of the RF power remains under 2.0:1 over a predetermined range of frequencies.

5. The attenuator of claim 4, wherein the predetermined range of frequencies is between 100 KHz to 60 GHz.

6. The attenuator of claim 1, wherein the temperature coefficient of resistance of one thermistor is zero.

7. The attenuator of claim 1, wherein the temperature sensor is a thermistor.

8. The attenuator of claim 1, wherein the temperature sensor is a resistance temperature detector.

9. The attenuator of claim 1, wherein the attenuator is formed by depositing onto a substrate thick-film resistors that have a resistance that varies with temperature.

10. The attenuator of claim 9, wherein the substrate is aluminum oxide (alumina), aluminum nitride (ALN), beryllium oxide (BeO), CVD diamond, or epoxy-glass laminate.

11. The attenuator of claim 1, wherein the attenuator is formed by depositing onto a substrate thin-film resistors that have a resistance that varies with temperature.

12. The attenuator of claim 11, wherein the substrate is aluminum oxide (alumina), aluminum nitride (ALN), beryllium oxide (BeO), CVD diamond, or epoxy-glass laminate.

13. An attenuator comprising:

a substrate of an insulating material having a first surface;

spaced first and second heater contact areas on the substrate surface;

a layer of heater resistor material on the substrate extending between and contacting the first and second heater contact areas;

a first temperature variable resistor layer on the substrate extending at least across a portion of the heater resistor material;

a second temperature variable resistor layer on the substrate extending at least across a portion of the heater resistor material;

an electrical connection between the first and second temperature variable resistor layers that forms a circuit in which attenuation changes with changes in the temperature of the first and second temperature variable resistance layer;

spaced first and second sensor contact areas on the substrate; and a temperature sensor resistor layer on the substrate contacting the first and second sensor contact areas and positioned such that the temperature sensor resistor layer can detect the temperature of the first and second temperature variable resistor layers;

wherein the attenuation of the attenuator can be varied by applying electrical energy to the heater resistor material.

14. The attenuator of claim 13 wherein the second temperature variable resistor layer has a temperature coefficient of resistance that is different from the temperature coefficient of resistance of the first temperature variable resistor layer.

15. The attenuator of claim 13, wherein the temperature coefficient of either the first or second temperature variable resistor layers, but not both, is zero.

16. The attenuator of claim 13, wherein the substrate is aluminum oxide (alumina), aluminum nitride (ALN), beryllium oxide (BeO), CVD diamond, or epoxy-glass laminate.

17. The attenuator of claim 13 further comprising a control circuit that receives a signal from the temperature sensor, compares the signal from the temperature sensor to a signal representative of a desired temperature, and applies electrical energy to the heating element until receiving information from the temperature sensor that the temperature of the first and second thermistors matches the desired temperature.

18. A method for forming an attenuator comprising the steps of:

forming spaced first and second heater contact areas on an insulating substrate;

forming a layer of heater resistor material on the substrate extending between and contacting the first and second heater contact areas;

forming a first temperature variable resistor layer on the substrate extending at least across a portion of the heater resistor material;

forming a second temperature variable resistor layer on the substrate extending at least across a portion of the heater resistor material;

forming an electrical connection between the first and second temperature variable resistor layers that forms a circuit in which attenuation changes with changes in the temperature of the first and second temperature variable resistance layers;

forming spaced first and second sensor contact areas on the substrate; and forming a temperature sensor resistor layer on the substrate contacting the first and second sensor contact areas and positioned such that the temperature sensor resistor layer can detect the temperature of the first and second temperature variable resistor layers;

wherein the attenuation of the attenuator can be varied by applying electrical energy to the heater resistor material.

* * * * *